US005641615A

United States Patent [19]

Haye et al.

[11] Patent Number: 5,641,615

[45] Date of Patent: Jun. 24, 1997

[54] PROCESSING SILVER HALIDE PHOTOGRAPHIC ELEMENTS WITH A NON-REHALOGENATING PEROXIDE BLEACHING COMPOSITION

[75] Inventors: Shirleyanne Elizabeth Haye; Sidney Joseph Bertucci; Eric Richard Schmittou, all of Rochester, N.Y.

[73] Assignee: Eastman Kodak Company, Rochester, N.Y.

[21] Appl. No.: 546,057

[22] Filed: Oct. 20, 1995

Related U.S. Application Data

[63] Continuation-in-part of Ser. No. 230,365, Apr. 20, 1994.

[51] Int. Cl.[6] ..... G03C 7/42

[52] U.S. Cl. ..... 430/430; 430/393; 430/461; 430/943

[58] Field of Search ..... 430/393, 430, 430/461, 943

[56] References Cited

U.S. PATENT DOCUMENTS

| | | | |
|---|---|---|---|
| 3,817,751 | 6/1974 | Matejec et al. | 430/373 |
| 3,905,907 | 9/1975 | Shiga | 134/3 |
| 4,045,225 | 8/1977 | Shimamura et al. | 430/373 |
| 4,113,490 | 9/1978 | Fujiwhara et al. | 430/373 |
| 4,277,556 | 7/1981 | Koboshi et al. | 430/393 |
| 4,301,236 | 11/1981 | Idota et al. | 430/393 |
| 4,328,306 | 5/1982 | Idota et al. | 430/393 |
| 4,414,305 | 11/1983 | Nakamura et al. | 430/373 |
| 4,454,224 | 6/1984 | Brien et al. | 430/393 |
| 4,469,780 | 9/1984 | Hirai et al. | 430/373 |
| 4,524,129 | 6/1985 | Kishimoto et al. | 430/393 |
| 4,557,898 | 12/1985 | Greene et al. | 252/100 |
| 4,578,345 | 3/1986 | Ohno et al. | 430/943 |
| 4,681,838 | 7/1987 | Mifune et al. | 430/943 |
| 4,717,649 | 1/1988 | Hall et al. | 430/460 |
| 4,745,043 | 5/1988 | Hirai | 430/203 |
| 4,781,854 | 11/1988 | Overton et al. | 252/100 |
| 4,880,725 | 11/1989 | Hirai et al. | 430/373 |
| 4,954,425 | 9/1990 | Iwano | 430/373 |
| 5,073,285 | 12/1991 | Liberati et al. | 252/100 |
| 5,215,675 | 6/1993 | Wilkins et al. | 252/100 |
| 5,244,593 | 9/1993 | Roselle et al. | 252/100 |
| 5,338,475 | 8/1994 | Corey et al. | 252/100 |
| 5,464,728 | 11/1995 | Szajewski et al. | 430/943 |

FOREIGN PATENT DOCUMENTS

| | | |
|---|---|---|
| 0428101A1 | 5/1991 | European Pat. Off. . |
| 48/46334 | 7/1973 | Japan . |
| 54/01026 | 6/1977 | Japan . |
| 61/250647 | 11/1986 | Japan . |
| 61/261739 | 11/1986 | Japan . |
| 92/01972 | 2/1992 | WIPO . |
| 92/07300 | 4/1992 | WIPO . |
| 93/11459 | 6/1993 | WIPO . |

*Primary Examiner*—Hoa Van Le

*Attorney, Agent, or Firm*—Sarah Meeks Roberts; J. Lany Tucker

[57] ABSTRACT

Imagewise exposed and developed black and white or color silver halide photographic elements are effectively bleached using a non-rehalogenating peroxide bleaching composition. This bleaching composition comprises hydrogen peroxide, or a precursor that can release hydrogen peroxide, and has a pH from 2 to 6, and at least one compound of Formula I:

$$R—(O)_n—SO_3M \quad (I)$$

wherein R is a group having 1 to 10 carbon atoms; n is 0 or 1; and M is a hydrogen atom, an alkali metal, an alkaline earth metal or an ammonium ion. Moreover, the bleaching composition is substantially free of rehalogenating agents, as well as complexes of a high valent metal ion and a polycarboxylic acid, an aminocarboxylic acid or a phosphonic acid.

16 Claims, 2 Drawing Sheets

PROCESSING SILVER HALIDE PHOTOGRAPHIC ELEMENTS WITH A NON-REHALOGENATING PEROXIDE BLEACHING COMPOSITION

RELATED APPLICATION

This application is a Continuation-in-part of U.S. Ser. No. 08/230,365, filed by the same inventors on Apr. 20, 1994.

FIELD OF THE INVENTION

This invention relates to processing of silver halide photographic elements. More specifically, this invention relates to the use of ecologically advantageous peroxide bleaching compositions to process silver halide photographic materials.

BACKGROUND OF THE INVENTION

The basic image-forming process of silver halide photography comprises the exposure of a silver halide photographic element to actinic radiation (for example, light or X-rays), and the manifestation of a usable image by the wet, chemical processing of the material. The fundamental steps of this processing entail, first, treatment (development) of the photographic element with one or more developing agents wherein some of the silver halide is reduced to metallic silver.

With black-and-white photographic elements, such metallic silver can serve directly as a useful image. With color photographic materials, the useful image consists of one or more images in organic dyes produced from an oxidized developing agent formed where silver halide is reduced to metallic silver. Following development, the photographic material may be further treated with a variety of solutions to achieve specific desired effects.

With black-and-white photographic elements, development usually produces a material containing both a metallic silver image in exposed areas, and (undeveloped) silver halide in unexposed areas. Silver halide is light-sensitive, and over time may be converted to metallic silver directly by the action of light, a process commonly referred to as print-out. To prevent contamination of the chemically developed metallic silver image by print-out silver, undeveloped silver halide is generally removed from the developed material through treatment with a solution containing a silver halide solvent commonly referred to as a fixing agent. The topic of fixing agents and their use in photographic processing is thoroughly discussed by G. I. P. Levenson in *The Theory of the Photographic Process*, Fourth Edition, T. H. James (ed.), Macmillan Publishing Co., Inc., New York, 1977, Chapter 15, and by L. F. A. Mason in *Photographic Processing Chemistry*, Second Edition, The Focal Press, London, 1975, Chapter VI.

In an alternative process, commonly referred to as a black-and-white reversal process, undeveloped silver halide is left in the black-and-white photographic material after development, but the metallic silver formed as a result of development is removed in a separate processing step. After the metallic (developed) silver has been removed, the photographic material is given a second exposure to actinic radiation sufficient to cause it to be convertible to metallic silver in a subsequent (second) development step. The result of this alternative process is a metallic silver image in areas of the material that were initially not exposed, giving a "reversal" of the image formed in the process in which the development is followed by fixing.

The processing solutions used to oxidize metallic (developed) silver in a photographic material are commonly referred to as bleaches. A thorough discussion of photographic bleaches is also given by Levenson and in Chapter VII of Mason in the references cited above. In addition to their use in the black-and-white reversal process just described, bleaches are also commonly used in the processing of color photographic materials to remove the metallic silver produced by development and, thereby, prevent desaturation of the color dye images.

All photographic bleaches are solutions of oxidizing agents capable of converting metallic silver to silver ions. Specifically, the oxidizing (bleaching) agents convert silver from an oxidation state of zero (silver metal) to silver in an oxidation state of +1. Simultaneously, the oxidizing agent is reduced. As discussed by Levenson in the cited reference, the oxidizing power required of the bleach may be quantified in terms of an electrochemical potential whose value depends on the concentration of free silver ions in the material being bleached. The higher the free silver ion concentration, the greater the oxidizing power required of the bleaching agent.

After chemical development, silver is present in a photographic material as metallic silver and as undeveloped silver halide. Since the solubility of each of these materials is negligible in water, the concentration of free silver ions in the material is negligible, and bleaching will begin if the material is exposed to a bleach solution containing even a weak oxidant. As the oxidation of metallic silver proceeds and free silver ion increases, the electrochemical potential needed to continue silver oxidation increases. Only bleaches containing oxidants with very high electrochemical potentials will be able to oxidize all of the metallic silver in a developed photographic material in the presence of the free silver ion products of bleaching. A table showing the electrochemical potentials of oxidants useful in photographic bleaches is given on page 448 of the Levenson reference. If the level of free silver ion is kept low, oxidants of weaker oxidizing power are useful in photographic bleaches. One way to maintain a low concentration of free silver ion in a bleaching photographic material is to include in the bleach composition chemical species that will combine with free silver ion as it is generated by the oxidation of developed (metallic) silver. Two common classes of materials used for this purpose are halides that react with free silver ions to form insoluble silver halides within the photographic materials, and silver ion complexing agents. These complexing agents are generally also silver halide solvents, and bleaching solutions containing such complexing agents may act as a fixing bath as well as a bleach. Single solutions used to both bleach and fix a developed photographic material are commonly referred to as bleach-fixing solutions or bleach-fixers. Thus there are three possible types of photographic bleaches, differing in the final disposition of the silver ions formed from the oxidation of metallic silver. Rehalogenating bleaches contain halide ion in the bleaching solution. After treatment with a rehalogenating bleach all silver in the photographic material is in the form of silver halide. This silver halide is subsequently removed from the material in a fixing step.

Bleach-fixers are bleaching solutions containing silver halide solvents. Use of a bleach-fixer eliminates a separate fixing step. All silver, both developed metallic silver and undeveloped silver halide, is removed from a processed photographic material in a bleach-fixer.

Finally, simple bleaches contain no material, for example, halides or silver ion complexing agents, which will significantly lower the concentration of free silver ions produced by the oxidation of metallic silver formed by development. These simple bleaches are sometimes referred to as direct or non-rehalogenating bleaches. Since these simple bleaches contain no silver halide solvents, they have no effect on undeveloped silver halide, so that when a simple bleach is used, developed silver in the photographic material being bleached dissolves into the bleach while undeveloped silver halide is removed into a fixing bath.

Not all oxidants are useful in all three types of bleaches, and the formulation of a useful composition for each of the three types of bleaches requires a careful balance of the electrochemical potential of the oxidant with the redox properties of all other species in the bleach solution and in the material to be bleached. For example, only the most powerful oxidants are useful in direct bleaches. Among these are soluble salts of dichromate and permanganate. As noted above, direct bleaches based on these materials are useful in a black-and-white reversal process. On the other hand, direct bleaches based on dichromate and permanganate are often too powerful to use in bleaching developed silver in color photographic materials because they can oxidize dye images, or in bleach-fixers because they are powerful enough to oxidize commonly used fixing agents. Other oxidants, such as those based on Fe(III) salts or Fe(III) complexes, are too weak to oxidize silver without additional species (like halide or a silver ion complexing agent) in the bleach to lower the concentration of free silver ion formed as bleaching proceeds. With bromide, for example, Fe(III) compounds such as ferricyanide and Fe(III)-EDTA are capable of oxidizing silver rapidly enough to be useful as bleaches in the processing of color materials but are not so powerful as to cause oxidation (loss) of color image dyes. Since most good fixing agents are more readily oxidized than color image dyes, bleach-fixing solutions are generally of lower oxidative power than either direct or rehalogenating bleaches. As a result, their use is restricted to processes designed for specific photographic materials. Process RA-4 used for color photographic paper containing emulsions with high levels of chloride does employ a bleach-fixer based on an Fe(III) complex, but no useful bleach-fixer for photographic materials containing emulsions of low chloride levels, for example, high speed color negative films, is commercially available.

Because the utility of an oxidant in a particular type of bleach depends critically on its electrochemical potential, it may not, in general, be assumed that oxidants useful in one type of bleach will also be useful in another. For example, one cannot prepare a useful simple (non-rehalogenating) bleach by taking a rehalogenating bleach based on Fe(III) —such as the KODAK FLEXICOLOR BLEACH III—and simply removing the halide.

In addition to selecting bleach components based on the need to oxidize developed silver, there is increasing concern with regard to the effects that oxidants and other bleach components may have on the environment. Powerful oxidants such as those based on Cr(VI) and Mn(VII) and weaker agents such as aminopolycarboxylic acid chelates of Fe(III) are of concern from the point of view of environmental pollution. Concerns center around the effects of the heavy metal ions themselves and around chelating agents like EDTA commonly employed with Fe(III) that may help transport heavy metals to the soil and aqueous environment. It is one purpose of the present invention to provide methods of bleaching that have minimum negative environmental effects.

On the basis of their electrochemical potential and innocuous bleaching products, peroxy compounds such as persulfates and peroxides offer attractive alternatives to heavy metal ion bleaches. Persulfate bleaching agents that produce sulfate ion as the bleaching byproduct, have low environmental impact. Although persulfates are powerful oxidants based on their electrochemical potential, it has been found that persulfate bleaches are slow to oxidize silver in developed photographic materials, and to achieve useful bleaching rates require the use of a bleach accelerating agent.

Like persulfates, hydrogen peroxide also has an electrochemical potential that suggests that it might be useful as an oxidant in photographic bleaches. The electrochemical potential of hydrogen peroxide is high enough to suggest its use in direct bleaches. In addition, the reduced form of hydrogen peroxide—the result of its oxidation of metallic silver—is water, which is excellent from an environmental perspective. In *Oxygen, Elementary Forms and Hydrogen Peroxide*, published by W. A. Benjamin, New York, 1965, M. Ardon teaches that persulfates can decompose to form hydrogen peroxide in aqueous solutions below pH 1. At higher pH values, at pH 2 to 6, however, persulfate does not act as a hydrogen peroxide precursor. Thus, hydrogen peroxide must be provided in other ways.

Not surprisingly, numerous attempts to use hydrogen peroxide as a photographic bleach have been made, yet no hydrogen peroxide based bleach has found its way into the photographic trade. One problem with many hydrogen peroxide bleach formulations has been stability. Another is the tendency of hydrogen peroxide based bleaches to produce vesiculation (blistering) in photographic materials and to show incomplete bleaching.

Still, the use of hydrogen peroxide in combination with various compounds has been described. For example, U.S. Pat. No. 4,301,236 (Idota et al) describes a rehalogenating bleaching composition containing a combination of hydrogen peroxide, an organic metal complex salt such as Fe(III) -EDTA or Fe(III)-HEDTA, and an unsubstituted or substituted aromatic sulfonic acid. The presence of the sulfonic acid is said to increase the shelf stability (keep stability) of the hydrogen peroxide formulation. The patent also teaches that hydrogen peroxide alone is not a useful oxidant for bleaching color photographic materials (column 2, lines 50–54). Contrary to this teaching, the present invention describes useful bleaches in which hydrogen peroxide is the only oxidant.

U.S. Pat. No. 4,277,556 (Koboshi et al) describes a photographic bleaching composition containing acidic formulations of hydrogen peroxide with lower alkyl aliphatic carboxylic acids and/or alkylidene diphosphonic acids or alkali metal salts thereof.

In addition, WO 92/01972 describes a method of processing a photographic material that includes a redox amplification dye image-forming step and a bleach step using hydrogen peroxide. Other disclosures include U.S. Pat. No. 4,454,224 and WO 92/07300 that describe alkaline hydrogen peroxide solutions, and Japanese specifications 61/250647A and 61/261739A that describe hydrogen peroxide bleaches requiring bleach accelerators.

Despite all of the work being done to develop hydrogen peroxide bleaches, there is a continuing need for methods of bleaching using commercially viable hydrogen peroxide bleaches that are stable and non-vesiculating. It is the object of this invention to provide useful methods of processing with nonrehalogenating hydrogen peroxide bleaches that are simple and effective.

SUMMARY OF THE INVENTION

This invention provides a method of processing an imagewise exposed and developed silver halide photographic element, the method comprising bleaching the element with a non-rehalogenating bleaching composition having a pH of from about 2 to about 6, and comprising:

a) hydrogen peroxide in an amount of from about 0.05 to about 5 mol/l or a hydrogen peroxide precursor compound which releases hydrogen peroxide in aqueous solution at a pH of from about 2 to about 6, the hydrogen peroxide precursor being present in the bleaching composition in an amount sufficient to release from about 0.05 to about 5 mol/l hydrogen peroxide, and b) from about 0.01 to about 2 mol/l of at least one compound of Formula I $$R—(O)_n—SO_3M \quad (I)$$

wherein

R is a group having 1 to 10 carbon atoms;

n is 0 or 1; and

M is a hydrogen atom, an alkali metal, an alkaline earth metal or an ammonium ion; and provided that the bleaching composition is substantially free of:

rehalogenating agents, and any complex of a high valent metal ion and a polycarboxylic acid represented by Formula II, an aminocarboxylic acid represented by Formula III or a phosphonic acid represented by Formula IV or V $$R^1(COOH)_t \quad (II)$$

wherein $R^1$ represents a single bond, an unsubstituted or substituted alkylene group having 1 to 6 carbon atoms wherein the substituent is a hydroxy group and/or a carboxy group, a $—(CH_2)_m—O—(CH_2)_n—$ group wherein m and n are integers and m+n is 2 to 6, a $—(CH_2)_{m'}—S—(CH_2)_{n'}—$ group wherein m' and n' are integers and m'+n' is 2 to 6, or an alkenylene group having 2 to 6 carbon atoms; t is 2 or 3; and when $R^1$ is a single bond, t is 2,

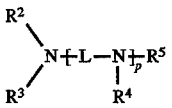

(III)

wherein $R^2$, $R^3$, $R^4$ and $R^5$ each represents a carboxyalkyl group wherein the alkyl moiety has 1 to 2 carbon atoms, a hydroxyalkyl group having 1 to 2 carbon atoms and/or a hydrogen atom; p represents zero or an integer of 1 to 3; L represents an alkylene group having 2 to 4 carbon atoms, a $$-[CH_2]_x-[O-[CH_2]_y]_z-$$

group wherein x is an integer of 2 to 4, y is an integer of 2 to 4 and z is an integer of 1 to 3, a 6-membered cyclic alkylene group, or an arylene group; and the aminocarboxylic acid of the formula (III) has at least 1 carboxy group, $$R^6-[PO_3H_2]_q \quad (IV)$$

$$R^6-[L-PO_3H_2]_q \quad (V)$$

wherein $R^6$ represents a substituted or unsubstituted alkyl or alkylene group having 1 to 4 carbon atoms wherein the substituent is a hydroxy group and/or a carboxy group, or a substituted or unsubstituted diaminoalkylene group having 2 to 16 carbon atoms wherein the substituent is a hydroxy group; L represents an alkylene group having 1 to 2 carbon atoms; and q represents an integer of 1 to 5.

The non-rehalogenating bleaching compositions used in the practice of this invention are effective, stable and non-vesiculating. These compositions suffer from no serious disadvantages that could limit their usefulness in photographic processing. Hydrogen peroxide is readily available, inexpensive and forms no by-products that are ecologically harmful. Moreover, these compositions work well in spite of the absence of rehalogenating agents, such as bromide, iodide and chloride, as well as in the absence of the complexes of high valent metal ions and acids described herein by Formulae II–V.

DETAILED DESCRIPTION OF THE INVENTION

Figure 1:
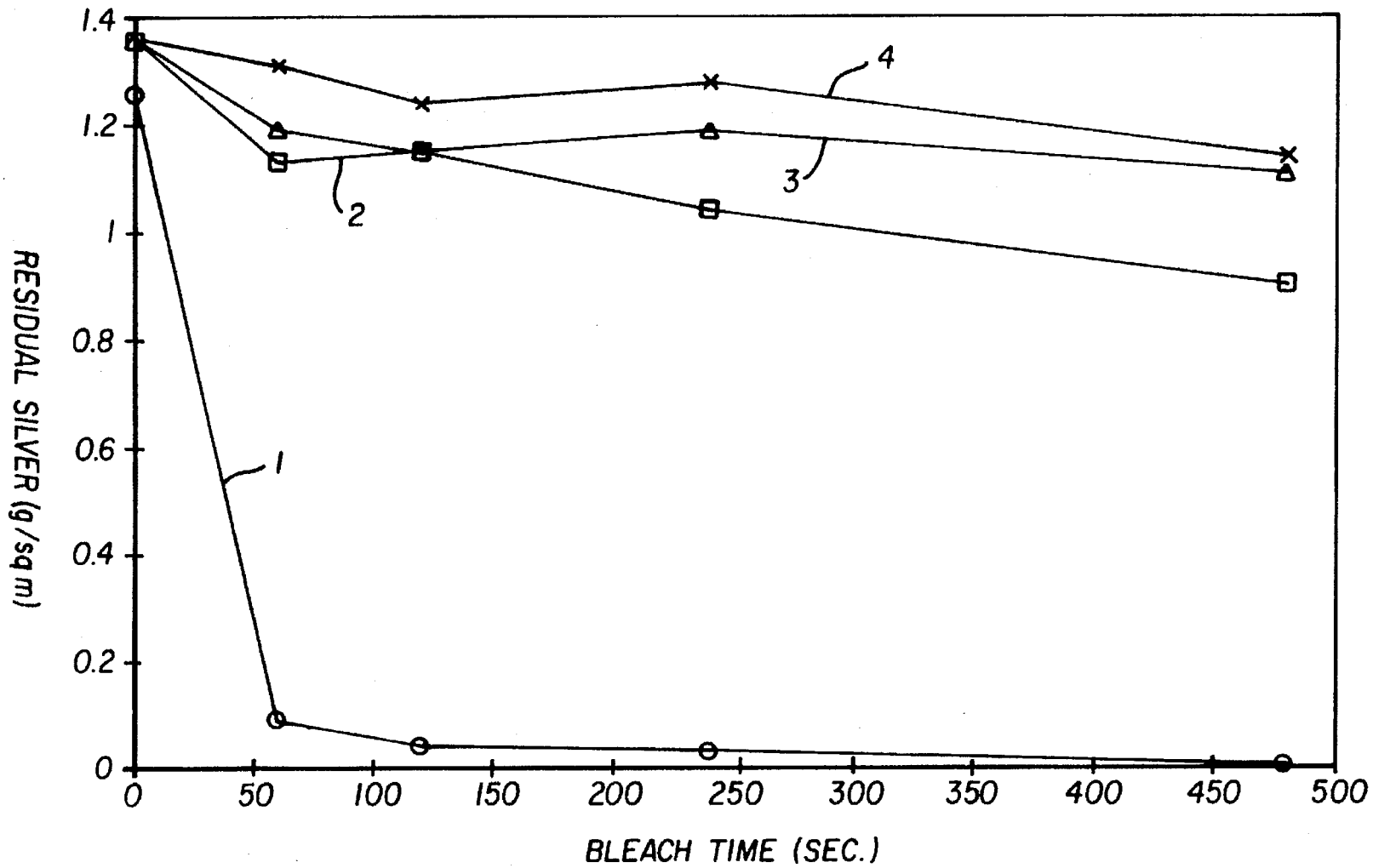
FIG. 1 is a graphical representation of the results (residual silver in $g/m^2$ vs. bleach time in seconds) of experiments carried out as described in Example 4 below.

The bleaching compositions useful in this invention include one or more sulfonic acids, sulfuric acid esters, or salts thereof having the general Formula I:

$$R—(O)_nSO_3M \quad (I)$$

wherein R represents a substituted or unsubstituted group having 1 to 10 carbon atoms. The R group may include saturated or unsaturated, aliphatic or aromatic, straight-chain or branched-chain groups or combinations thereof. In one preferred embodiment R is non-aromatic. The R group can contain only carbon atoms or it can contain one or more nitrogen, oxygen, phosphorus, sulfur or halogen atoms. The R group can also contain one or more ether groups, thioether groups, amine groups, amide groups, ester groups, carbonyl groups, sulfonyl groups, sulfonamide groups, hydroxy groups, sulfate groups, sulfo groups, or cyano groups.

Representative substituents of R include, for example, alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxy groups, cyano groups, and amino groups.

Preferably, R is substituted with one or more hydroxy groups, amino groups, ether groups, sulfonic acid or sulfonate groups, carboxylic acid or carboxylate groups, or phosphonic acid or phosphonate groups. Particularly R groups include methyl, ethyl, propyl, butyl, pentyl, hexyl, phenyl, naphthyl, 2-hydroxyethyl, 2-aminoethyl, 2-hydroxypropyl, 2-(N-morpholino)ethyl, 3-(N-morpholino)-2-hydroxypropyl, 3-(N-morpholino)propyl, N-tris(hydroxymethyl)methyl-3-aminopropyl, N-tris(hydroxymethyl)methyl-2-aminoethyl, 3-(cyclohexylamino)-2-hydroxypropyl and 3-(cyclohexylamino)propyl.

In Formula I, n is 0 or 1, and preferably, it is 0. M is hydrogen, an ammonium atom defined as a mono-, di-, tri-, or tetra- substituted ammonium ion, which may be substituted with 1–4 aryl groups or alkyl groups with 1–6 carbon atoms, or an alkali metal or alkaline earth metal cation. More preferably M is hydrogen or a sodium or potassium ion.

Specific examples of useful compounds include, but are not limited to:

methanesulfonic acid methyl potassium sulfate aminoethanesulfonic acid 2-hydroxyethanesulfonic acid 2-(N-morpholino)ethanesulfonic acid 3-(N-morpholino)propanesulfonic acid 3-(N-morpholino)-2-hydroxypropanesulfonic acid 3-(N-(tris(hydroxymethyl)methyl)amino)propanesulfonic acid 3-(N-(tris(hydroxymethyl)methyl)amino)-2-hydroxypropanesulfonic acid 3-(cyclohexylamino)-1-propanesulfonic acid 3-(cyclohexylamino)-2-hydroxy-1-propanesulfonic acid ethanesulfonic acid propanesulfonic acid butanesulfonic acid hexanesulfonic acid benzenesulfonic acid naphthalenesulfonic acid 2-(N-(tris(hydroxymethyl)methyl)amino)ethane sulfonic acid sulfoacetic acid sulfosuccinic acid The compounds of Formula I may be used at a concentration of from about 0.01 to about 2.0 mol/l. More preferably the compounds are used at a concentration of from about 0.03 to about 1.0 mol/l, and most preferably from about 0.045 to about 0.5 mol/l. The compounds of Formula I may be used individually or in combinations of two or more.

The bleaching agent utilized in the bleaching compositions is hydrogen peroxide or a hydrogen peroxide precursor such as perborate, percarbonate, or hydrogen peroxide urea. For purposes of this invention, persulfate is not a precursor for hydrogen peroxide because in aqueous solutions at a pH of from about 2 to about 6, persulfate fails to generate sufficient amounts of hydrogen peroxide to be useful as a hydrogen peroxide precursor in the practice of this invention (see "Comparative Experimentation A" below).

The amount of hydrogen peroxide or hydrogen peroxide precusor used in the bleaching composition described herein depends on many variables including the kind of compound used in combination with the hydrogen peroxide, the type of photographic material, the processing time and the processing temperature (see suggested times and temperatures below). In general, the smaller the added amount, the longer the treatment period necessary. When the added amount is greater than necessary, the reaction becomes extremely active and vesiculation may occur. A worker skilled in the art would know how to determine the appropriate amount of hydrogen peroxide or hydrogen peroxide precusor for a given set of conditions using routine experimentation.

Thus, the hydrogen peroxide bleaching agent is generally present in an amount of from about 0.05 to about 5 mol/l, and more preferably from about 0.1 to about 3 mol/l, depending upon the various factors noted above. For example, for processing silver bromoiodide emulsions, most preferably, the hydrogen peroxide is present in an amount of from about 1 to about 2.5 mol/l. When a hydrogen peroxide precursor is used, the amount of precursor present must be that sufficient to provide the just described amounts of hydrogen peroxide at the composition pH. A skilled artisan would know how to determine this amount of precursor using routine experimentation.

Examples of hydrogen peroxide formulations are described, for example, in *Research Disclosure*, publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". Additional hydrogen peroxide formulations are described in U.S. Pat. Nos. 4,277,556; 4,328,306; 4,454,224; 4,717,649; 4,737,450; 4,301,236; and in EP 0,428,101; WO 92/01972 and WO 92/07300.

In a preferred embodiment, an organic phosphonic acid is added to the bleaching composition used in this invention. Preferred phosphonic acids have Formulas VI or VII:

$$R^7N(CH_2PO_3M'_2)_2 \quad \text{(VI)}$$

wherein M' represents a hydrogen atom or a cation imparting water solubility (e.g., an alkali metal) or an ammonium, pyridinium, thiethanolammonium or triethylammonium ion). $R^7$ represents an alkyl group, an alkylaminoalkyl group, or an alkoxylalkyl group having from 1 to 4 carbon atoms (e.g., methyl, ethyl, propyl, isopropyl, and butyl groups, ethoxyethyl and ethylaminoethyl groups), an aryl group (e.g., phenyl, o-tolyl, m-tolyl, p-tolyl and p-carboxyphenyl groups,), an aralkyl group (e.g., benzyl, β-phenethyl, and o-acetamidobenzyl groups, and preferably an aralkyl group having from 7 to 9 carbon atoms), an allcyclic group (e.g., cyclohexyl and cyclopentyl groups), or a heterocyclic group (e.g., 2-pyridylmethyl, 4-(N-pyrrolidino)butyl, 2-(N-morpholino)ethyl, benzothiazolylmethyl, and tetrahydroquinolylmethyl groups), each of which (particularly the alkyl group, the alkoxyalkyl group, or the alkylaminoalkyl group) may be substituted with a hydroxyl group, an alkoxy group (e.g., methoxy and ethoxy groups), a halogen atom, or $—PO_3M'_2$, $—CH_2PO_3M'_2$, or $—N(CH_2PO_3M'_2)_2$, wherein M' is as defined above.

$$R^8R^9C(PO_3M'_2)_2 \quad \text{(VII)}$$

For Formula VII, M' is as defined above. $R^8$represents a hydrogen atom, an alkyl group, an aralkyl group, an alicyclic group, or a heterocyclic group,or $—CHR^{10}—PO_3M'_2$ (wherein M' is as defined above; and $R^{10}$ represents a hydrogen atom, a hydroxy group, or an alkyl group), or $—PO_3M'_2$ (wherein M' is as defined above). $R^9$ represents a hydrogen atom, a hydroxyl group or an alkyl group, or the above defined substituted alkyl group, or $—PO_3M'_2$ wherein M' is as defined above.

Representative examples of useful phosphonic acids are shown below.

(1) Ethylenediamine-N,N,N',N'-tetramethylenephosphonic acid
(2) Nitrilo-N,N,N-trimethylenephosphonic acid
(3) 1,2-Cyclohexanediamine-N,N,N',N'-tetramethylenephosphonic acid
(4) o-Carboxyaniline-N,N-dimethylenephosphonic acid
(5) Propylamine-N,N-dimethylenephosphonic acid
(6) 4-(N-Pyrrolidino)butylamine-N,N-bis (methylenephosphonic acid)
(7) 1,3-Diamino-2-propanol-N,N,N',N'-tetramethylenephosphonic acid
(8) 1,3-Propanediamine-N,N,N',N'-tetramethylenephosphonic acid
(9) 1,6-Hexanediamine-N,N,N',N'-tetramethylenephosphonic acid
(10) o-Acetamidobenzylamine-N,N-dimethylenephosphonic acid
(11) o-Toluidine-N,N-dimethylenephosphonic acid
(12) 2-Pyridylmethylamine-N,N-dimethylenephosphonic acid
(13) 1-Hydroxyethane-1,1-diphosphonic acid
(14) Diethylenetriamine-N,N,N',N",N"-penta (methylenephosphonic acid)
(15) 1-Hydroxy-2-phenylethane-1,1-diphosphonic acid
(16) 2-Hydroxyethane-1,1-diphosphonic acid
(17) 1-Hydroxyethane-1,1,2-triphosphonic acid
(18) 2-Hydroxyethane-1,1,2-triphosphonic acid
(19) Ethane-1,1-diphosphonic acid
(20) Ethane-1,2-diphosphonic acid The optional organic phosphonic acid compound can be present in the bleaching composition in an amount of from about 0.0005 to about 0.02 mol/l, and preferably from about 0.0005 to about 0.012 mol/l. The use of the phosphonic acid compound in the bleaching composition reduces vesiculation during processing.

For the purpose of minimizing any further reaction of oxidized color developing agent with dye-forming compounds in the photographic element during bleaching, it is necessary that one or more additional treatments be performed between color development and bleaching as described herein. Among such treatments are contacting the element with an acidic processing solution (such as dilute sulfuric or acetic acid stop bath solutions or buffer solutions with a pH preferably from about 1 to about 7); contacting the element with a water wash bath (or rinse) having a pH ranging from about 3 to about 7; or wiping the photographic element with a squeegee or other device that minimizes the amount of processing solution that is carried by the photographic element from one processing solution to another. Most preferably, an acidic stop bath is used between color development and hydrogen peroxide bleaching.

The described bleaching compositions generally have a pH of from about 2 to about 6, and preferably a pH of from about 3 to about 6. Preferably, the stop or rinse bath used before bleaching has a pH of $\leqq 7$. The bleaching compositions can adequately bleach a wide variety of photographic elements in from about 30 to about 600 seconds. The processing temperature of the bleaching solution is from about 20° to about 60° C., and more preferably from about 25° to about 40° C. for rapid treatment.

Further, it has been found that bleaching can be enhanced when silver(I) is present in the bleaching composition. Silver(I) can be provided from any suitable source, and particularly from inorganic and organic silver salts added to the composition. Many useful salts are well known in the art. For reasons of effectiveness, availability, low cost and environmental concerns, the preferred silver salts are the nitrate, sulfate, acetate, lactate, and methanesulfonate salts. Alternatively, silver(I) can be provided from metallic silver added to the bleaching composition or from oxidized silver from the photographic material.

The amount of silver that may be added to the bleaching composition can be from about $10^{-5}$ to about $5\times10^{-1}$ mol/l, and preferably from about $10^{-4}$ to about $10^{-1}$ mol/l. This amount may vary depending on the kind of salts used, the type of silver halide photographic materials to be treated, treatment times, and treatment conditions.

As noted above, the bleaching compositions used in this invention are "non-rehalogenating". No rehalogenating agent (such as iodide, bromide or chloride) is purposely added to the bleaching compositions. There may be inconsequential amounts, that is less than $10^{-5}$ mol/l of soluble halide, that leach out of processed elements or are carried over from preceding processing solutions.

In the absence of rehalogenating amounts of soluble halide in the bleaching composition, the developed silver of the photographic element is dissolved and partially or completely washed out of the element and into the bleaching solution once it has become oxidized by the bleaching solution.

The bleaching composition used in this invention is also substantially free of a complex of a high valent metal ion and any of a polycarboxylic acid represented by Formula II, an aminocarboxylic acid represented by Formula III or a phosphonic acid represented by Formula IV or V. In this context, the term "substantially free" means less than about $10^{-4}$ mol/l of the high valent metal ion. Such amounts are ineffective as bleaching agents.

The polycarboxylic acids are defined as:

$$R^1(COOH)_t \qquad \text{(II)}$$

wherein $R^1$ represents a single bond, an unsubstituted or substituted alkylene group having 1 to 6 carbon atoms wherein the substituent is a hydroxy group and/or a carboxy group, a $-(CH_2)_m-O-(CH_2)_n-$ group wherein m and n are integers and m+n is 2 to 6, a $-(CH_2)_{m'}-S-(CH_2)_{n'}-$ group wherein m' and n' are integers and m'+n' is 2 to 6, or an alkenylene group having 2 to 6 carbon atoms; t is 2 or 3, and when $R^1$ is a single bond, t is 2.

The aminocarboxylic acids are defined as:

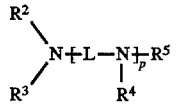

(III)

wherein $R^2$, $R^3$, $R^4$ and $R^5$ each represents a carboxyalkyl group wherein the alkyl moiety has 1 to 2 carbon atoms, a hydroxyalkyl group having 1 to 2 carbon atoms and/or a hydrogen atom; and p represents zero or an integer of 1 to 3. L represents an alkylene group having 2 to 4 carbon atoms; a $$-[CH_2]_x-[O-[CH_2]_y]_z-$$

group wherein x is an integer of 2 to 4, y is an integer of 2 to 4 and z is an integer of 1 to 3; a 6-membered cyclic alkylene group; or an arylene group. The aminocarboxylic acid of the formula (III) has at least 1 carboxy group.

The phosphonic acids are defined as:

$$R^6[PO_3H_2]_q \quad (IV)$$

$$R^6[LPO_3H_2]_q \quad (V)$$

wherein $R^6$ represents a substituted or unsubstituted alkyl or alkylene group having 1 to 4 carbon atoms wherein the substituent is a hydroxy group and/or a carboxy group, or a substituted or unsubstituted diaminoalkylene group having 2 to 16 carbon atoms wherein the substituent is a hydroxy group. L represents an alkylene group having 1 to 2 carbon atoms; and q represents an integer of 1 to 5.

A high valent metal ion has a normal valence greater than +1. Examples are iron(II), iron(III), copper(II), cobalt(II) and nickel(II). For example, the bleaching compositions used in this invention are substantially free of iron complexes of the noted organic acids (such as PDTA or EDTA). It should be noted that silver, in its normal valence state (+1), is not a high valent metal ion.

Examples of counterions which may be associated with the various salts in these bleaching compositions are sodium, potassium, ammonium, tetraalkylammonium and pyridinium cations. It may be preferable to utilize alkali metal cations. Additionally, the bleaching compositions may contain corrosion inhibitors, such as nitrate ion.

The bleaching compositions may also contain other addenda known in the art to be useful in bleaching compositions, such as sequestering agents, polymers such as poly-N-vinylpyrrolidone, fluorescent brightening agents, and defoamers and other kinds of surface active agents. The bleaching compositions may also contain, depending upon the kind of photographic materials to be treated, hardening agents such as an alum or antiswelling agents, for example, magnesium sulfate.

The bleaching compositions may also contain one or more buffering agents that will maintain the composition pH at from about 2 to about 6. Such buffering agents include phosphates, sulfates, acetic acid, sodium acetate, and others known in the art. If necessary, the compositions can contain hydrogen peroxide stabilizers such as acetanilide, pyrophosphoric acid, urea oxine, barbituric acid and mixtures of metal complexing agents as described in WO 93/11459. The bleaching compositions described herein may be formulated as the working bleaching solutions, solution concentrates, or dry powders. They may be used as bleach replenishers as well.

In addition, the compound of Formula I may be used in combination with water-soluble aliphatic carboxylic acids such as acetic acid, citric acid, propionic acid, hydroxyacetic acid, butyric acid, malonic acid, succinic acid and the like. These may be utilized in any effective amount. The compounds of Formula I may also be used in combination with aromatic carboxylic acids, particularly those having the formula $$[MO_2C-(L^1)_p]_q-R-[(L^2)_n-CO_2M]_m$$

wherein R is a substituted or unsubstituted aromatic hydrocarbon group, or a substituted or unsubstituted aromatic heterocyclic group containing at least one oxygen, nitrogen or sulfur atom; $L^1$ and $L^2$ are each independently a substituted or unsubstituted linking group wherein the linking group is attached to the carboxyl group by a carbon; n and p are independently 1 or 0; m and q are independently 0, 1, 2, 3, 4, 5, or 6 and the sum of m+q is at least 1; and M is a hydrogen atom, an alkali metal, an alkaline earth metal or an ammonium ion.

Examples of how the bleaching compositions of this invention may be utilized are shown below, but the invention is not limited to these illustrated embodiments:

(1) Black and white first development→stopping→water washing→color development→stopping→bleaching→water washing→stabilization→drying.

(2) Black and white first development→water washing → fog bath→color development→rinsing→bleaching→water washing→stabilization→drying.

(3) Pre-hardening→neutralization→black and white first development→water washing→color development→stopping→bleaching→washing→stabilization→drying.

(4) Black and white first development→stopping→water washing→color development→hardening→neutralization→bleaching→water washing→stabilization→drying.

(5) Black and white first development→stopping→color development→stopping→black and white second development→rinsing→bleaching→water washing→stabilization→drying.

(6) Black and white first development→stopping→water washing→color development→stopping→bleaching→water washing→stabilization→drying.

(7) Black and white first development→stopping→bleaching→water washing→color development→stopping→bleaching→water washing→stabilization→drying.

(8) Black and white first development→water washing→fog bath→color development→stopping→water washing→bleaching→washing→fixing→washing→stabilization→drying.

(9) Black and white development→stopping→washing→bleaching→washing→fixing→washing→stabilization→drying.

(10) Black and white first development→stopping→washing→bleaching→washing→fogging→black and white second development→washing→stabilization→drying.

(11) Color development→stopping→water washing→bleaching→fixing→water washing→stabilization→drying.

(12) Color development→rinsing→bleaching→fixing → water washing→stabilization→drying.

(13) Color development→stop-fixing→water washing → bleaching→water washing→stabilization→drying.

(14) Color development→stopping→bleaching→water washing→stabilization→drying.

(15) Hardening→neutralization→color development→rinsing→bleaching→water washing→stabilization→drying.

(16) Color development→stopping→water washing→black and white development→water washing→bleaching→washing→stabilization→drying.

(17) Color development→water washing→dye→bleaching→water washing→bleaching→water washing.

(18) Color development→stopping→water washing→bleaching→water washing→fixing→water washing→stabilization→drying.

(19) Color development→stopping→water washing→black and white development→water washing→bleaching→washing→fixing→washing→stabilization→drying.

The compositions of this invention may be useful with Low Volume Thin Tank processors. A Low Volume Thin Tank processor provides a small volume for holding the processing solution. As a part of limiting the volume of the processing solution, a narrow processing channel is provided. The processing channel, for a processor used for photographic paper, should have a thickness equal to or less than about 50 times the thickness of the paper being processed, preferably a thickness equal to or less than about 10 times the paper thickness. In a processor for processing photographic film, the thickness of the processing channel should be equal to or less than about 100 times the thickness of photosensitive film, preferably, equal to or less than about 18 times the thickness of the photographic film. An example of a low volume thin tank processor that processes paper having a thickness of about 0.008 inches would have a channel thickness of about 0.08 inches and a processor that processes film having a thickness of about 0.0055 inches would have a channel thickness of about 0.10 inches. Further details about such processing methods and equipment are provided in U.S. Pat. No. 5,436,118 (Carli et al), incorporated herein by reference and in publications cited therein.

This invention may use any compatible fixing solution. Examples of fixing agents that may be used are water-soluble solvents for silver halide, such as a thiosulfate (e.g., sodium thiosulfate and ammonium thiosulfate); a thiocyanate (e.g., sodium thiocyanate and ammonium thiocyanate); a thioether compound (e.g., ethylenebisthioglycolic acid and 3,6-dithia-1,8-octanediol); a thiourea; or a sulfite (e.g., sodium sulfite). These fixing agents can be used singly or in combination.

The concentration of the fixing agent per liter is preferably from about 0.1 to about 3 mol/l. The pH range of the fixing solution is preferably from about 3 to about 10 and more preferably from about 4 to about 9. In order to adjust the pH of the fixing solution an acid or a base may be added, such as hydrochloric acid, sulfuric acid, phosphoric acid, nitric acid, acetic acid, bicarbonate, ammonia, potassium hydroxide, sodium hydroxide, sodium carbonate or potassium carbonate.

The fixing solution may also contain a preservative such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). The content of these compounds is generally from 0 to about 1.0 mol/l, and more preferably from about 0.02 to about 0.70 mol/l as an amount of sulfite ion. Ascorbic acid, a carbonyl bisulfite acid adduct, or a carbonyl compound may also be used as a preservative.

The bleaching and fixing baths may be in any desired tank configuration including multiple tanks, counter current and/or co-current flow tank configurations.

A stabilizer bath is commonly employed for final washing and/or hardening of the bleached and fixed photographic element prior to drying. Alternatively, a final rinse may be used. Additionally, a bath can be employed prior to color development, such as a prehardening bath, or a washing step may follow the stabilizing step. Other additional washing or stopping steps may be utilized. Additionally, reversal processes that have the additional steps of black and white development, chemical fogging bath, light re-exposure, and washing before the color development can be carried out with this invention. In reversal processing, there is often a bath that precedes the bleach that may serve many functions, such as a clearing bath or a stabilizing bath. Conventional techniques for processing are illustrated by *Research Disclosure*, noted above.

This invention can be used for bleaching a wide variety of black and white and color silver halide based photographic materials. The preferred elements for bleaching comprise silver halide emulsions such as silver bromide, silver iodide, silver bromoiodide, silver chloride, silver chloroiodide, silver chlorobromide and silver chlorobromoiodide emulsions.

The photographic elements of this invention can be black and white elements, single color elements, or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in U.S. Pat. No. 4,362,806. The element can also contain additional layers such as filter layers, interlayers, overcoat layers, subbing layers and the like. The element may also contain a magnetic backing such as described in No. 34390, *Research Disclosure*, November 1992.

The silver halide emulsions employed in the elements of this invention can be either negative-working or positive-working. Examples of suitable emulsions and their preparation are described in *Research Disclosure*, noted above. Other suitable emulsions are (111) tabular silver chloride emulsions such as described in U.S. Pat. Nos. 5,176,991 (Jones et al); 5,176,992 (Maskasky et al); 5,178,997 (Maskasky); 5,178,998 (Maskasky et al); 5,183,732 (Maskasky); and 5,185,239 (Maskasky) and (100) tabular silver chloride emulsions such as described in EPO 534,395, published Mar. 31, 1993, (Brust et al). Some of the suitable vehicles for the emulsion layers and other layers of elements of this invention are described in *Research Disclosure*, noted above.

The silver halide emulsions can be chemically and spectrally sensitized in a variety of ways, examples of which are described in *Research Disclosure*, noted above. The elements of the invention can include various couplers including, but not limited to, those described in *Research Disclosure*, noted above. These couplers can be incorporated in the elements and emulsions as described in *Research Disclosure*, noted above and publications cited therein.

The photographic elements of this invention or individual layers thereof can contain among other things brighteners, antifoggants and stabilizers, antistain agents and image dye stabilizers, light absorbing and scattering materials, hardeners, plasticizers and lubricants, antistatic agents, matting agents and development modifiers, examples of all of which are described in *Research Disclosure*, noted above and publications cited therein.

The photographic elements can be coated on a variety of supports including, but not limited to, those described in *Research Disclosure*, noted above and the references described therein.

Photographic elements can be exposed to actinic radiation, typically in the visible region of the spectrum, to form a latent image and then processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

For black and white development the common black and white developers may be used. They may be used in a black and white first development solution for light-sensitive color photographic materials, or black and white development solutions for light-sensitive black and white photographic materials. Some examples of typical developing agents include the p-aminophenols, such as Metol; the polyhydroxybenzenes such as hydroquinone and catechol; and the pyrazolidones (phenidones), such as 1-phenyl-3-pyrazolidone. These developers may be utilized alone or in combination.

Representative additives that may be used with black and white developers include anti-oxidizing agents such as sulfites; accelerators comprising an alkali such as sodium hydroxide, sodium carbonate and potassium carbonate; organic or inorganic retarders such as potassium bromide, 2-mercaptobenzimidazole or methylbenzthiazole; water softeners such as polyphosphates; or surface development-preventing agents comprising a trace amount of potassium iodide or mercaptides.

The color developing solutions typically contain a primary aromatic amino color developing agent. These color developing agents are well known and widely used in variety of color photographic processes. They include aminophenols and p-phenylenediamines.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene, and the like.

Particularly useful primary aromatic amino color developing agents are the p-phenylenediamines and especially the N-N-dialkyl-p-phenylenediamines in which the alkyl groups or the aromatic nucleus can be substituted or unsubstituted. Examples of useful p-phenylenediamine color developing agents include: N-N-diethyl-p-phenylenediamine monohydrochloride, 4-N,N-diethyl-2-methylphenylenediamine monohydrochloride, 4-(N-ethyl-N-2-methanesulfonylaminoethyl)-2-methylphenylenediamine sesquisulfate monohydrate, and 4-(N-ethyl-N-2-hydroxyethyl)-2-methylphenylenediamine sulfate.

In addition to the primary aromatic amino color developing agent, color developing solutions typically contain a variety of other agents such as alkalies to control pH, bromides, iodides, benzyl alcohol, antioxidants, antifoggants, solubilizing agents, brightening agents, and so forth. Particularly useful antioxidants are substituted dialkylhydroxylamines, such as N-isopropyl-N-(ethanesulfonic acid)hydroxylamine.

Photographic color developing compositions are employed in the form of aqueous alkaline working solutions having a pH of above about 7 and most typically in the range of from about 9 to about 13. To provide the necessary pH, they contain one or more of the well known and widely used pH buffering agents, such as the alkali metal carbonates or phosphates. Potassium carbonate is especially useful as a pH buffering agent for color developing compositions.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

As used herein to define amounts and times, the term "about" refers to a variance of ±10% of the indicated value; for temperature, it refers to a variance of ±5° C.; and for pH it refers to a variance of ±0.25 pH unit.

The following examples are intended to illustrate, but not limit, this invention. Unless otherwise indicated, all percentages are by weight.

EXAMPLE 1

KODACOLOR GOLD 100 Film, a standard color negative film containing predominantly silver bromoiodide emulsions, was given a flash exposure at 1/25 sec with a DLVA filter and a 3000 K color temperature lamp on a 1B-sensitometer. The strips were processed as follows:

| Solution | Time | Temp |
|---|---|---|
| COLOR DEVELOPER | 3.25 min | 40° C. |
| STOP BATH | 1 min | " |
| TAP WATER WASH | 1 min | " |
| BLEACH | 0–8 min | 25° C. |
| TAP WATER WASH | 3 min | 40° C. |
| FIXER | 4 min | " |
| TAP WATER WASH | 3 min | " |
| STABILIZER | 1 min | " |

Color Developer

| | |
|---|---|
| Potassium carbonate | 34.30 g/l |
| Potassium bicarbonate | 2.32 g/l |
| Sodium sulfite | 0.38 g/l |
| Sodium metabisulfite | 2.78 g/l |
| Potassium iodide | 1.20 mg/l |
| Sodium bromide | 1.31 g/l |
| Diethylenetriaminepentaacetic acid pentasodium salt | 3.37 g/l |
| Hydroxylamine sulfate | 2.41 g/l |
| 4-(N-ethyl-N-(2-hydroxyethyl)-amino)-2-methylaniline sulfate | 4.52 g/l |
| pH | 10.0 |

Acid Stop Bath

| | |
|---|---|
| Sulfuric acid | 10 mL/l |

Fixer

| | |
|---|---|
| Ammonium thiosulfate | 124.6 g/l |
| Ammonium sulfite | 8.83 g/l |
| Ethylenedinitrilotetraacetic acid, disodium salt, dihydrate | 1.45 g/l |
| Sodium metabisulfite | 5.5 g/l |
| Acetic acid | 0.97 g/l |
| Water to make | 1 liter |
| pH | 6.4 |

Stabilizer

| | |
|---|---|
| Photo-Flo 200 Solution (manufactured by Eastman Kodak Co.) | 3 mL/l |

Bleach A (Comparison)
0.98 mol/l $H_2O_2$
Water to 1 liter
pH 3.54 adjusted with $HNO_3$
Bleach B (Invention)
0.98 mol/l $H_2O_2$
0.17 mol/l 2-(N-Morpholino)ethanesulfonic Acid (MES)
Water to 1 liter
pH 3.65 adjusted with $HNO_3$ Film sample A was treated with peroxide Bleach A (comparison) and film sample B was treated with peroxide Bleach B (Invention) at room temperature (25° C.). After processing, the strips were air dried and IR (infrared)

densities were determined spectrophotometrically at 900 nm. The IR densities are tabulated in Table I. The bleach times were varied from 0 to 8 minutes to determine bleach effectiveness.

TABLE I

| IR density data at 900 nm | | |
|---|---|---|
| BLEACH TIME (SEC) | SAMPLE A (25° C.) | SAMPLE B (25° C.) |
| 0.0 | 2.080 | 2.080 |
| 240 | 1.119 | 0.350 |
| 480 | 0.958 | 0.222 |

The infrared density corresponds to the amount of unbleached silver in the film. A lower IR density means that more metallic silver has been bleached. Comparison of the IR densities shows the improved performance of the invention, Bleach B. While severe film vesiculation was caused by Bleach A, no obvious vesiculation was observed with Bleach B.

EXAMPLE 2

KODACOLOR GOLD 100 Film was given a step wedge test object exposure at 1/25 sec. with DLVA filter and a 3000 K color temperature lamp on a 1B-sensitometer. The strips were processed according to the sequence described in example 1. The residual silver of the samples was determined at maximum density by X-ray fluorescence, and is tabulated in Table II.

Bleach C (Comparison)

0.98 mol/l $H_2O_2$ 0.004 mol/l 1-hydroxyethylidene-1,1-diphosphonic acid

Water to 1 liter pH 3.0 adjusted with NaOH

Bleach D (Invention)

0.98 mol/l $H_2O_2$ 0.33 mol/l $CH_3SO_3H$ 0.004 mol/l 1-hydroxyethylidene-1,1-diphosphonic acid Water to 1 liter pH 3.0 adjusted with NaOH

TABLE II

| X-ray fluorescence data for residual silver in g/m$^2$ | | |
|---|---|---|
| BLEACH TIME (SEC) | SAMPLE C (25° C.) | SAMPLE D (25° C.) |
| 0.0 | 1.360 | 1.490 |
| 120 | 1.282 | 0.168 |
| 240 | 0.267 | 0.041 |
| 480 | 0.058 | 0.023 |

The X-ray fluorescence data for samples C and D show that at room temperature, the bleaching action of the invention, Bleach D, is faster and more complete than the bleaching action of Bleach C, which does not contain methanesulfonic acid. No vesiculation was observed with these solutions.

EXAMPLE 3

KODACOLOR GOLD 100 Film was given a step wedge test object exposure at 1/25 sec. with DLVA filter and a 3000 K color temperature lamp on a 1B-sensitometer. The strips were processed at 40° C., according to the following sequence. The bleach time was varied as shown to determine bleaching effectiveness.

| Solution | Time |
|---|---|
| COLOR DEVELOPER | 3.25 min |
| STOP BATH | 1 min |
| TAP WATER WASH | 1 min |
| BLEACH | 0–8 min |
| TAP WATER WASH | 3 min |
| FIXER | 4 min |
| TAP WATER WASH | 3 min |
| STABILIZER | 1 min |

Color Developer

| | |
|---|---|
| Potassium carbonate | 34.30 g/l |
| Potassium bicarbonate | 2.32 g/l |
| Sodium sulfite | 0.38 g/l |
| Sodium metabisulfite | 2.78 g/l |
| Potassium iodide | 1.20 mg/l |
| Sodium bromide | 1.31 g/l |
| Diethylenetriaminepentaacetic acid pentasodium salt | 3.37 g/l |
| Hydroxylamine sulfate | 2.41 g/l |
| 4-(N-ethyl-N-(2-hydroxyethyl)-amino)-2-methylaniline sulfate | 4.52 g/l |
| pH | 10.0 |

Acid Stop Bath

| | |
|---|---|
| Sulfuric acid | 10 ml/l |

Fixer

| | |
|---|---|
| Ammonium thiosulfate | 124.6 g/l |
| Ammonium sulfite | 8.83 g/l |
| Ethylenedinitrilotetraacetic acid, disodium salt, dihydrate | 1.45 g/l |
| Sodium metabisulfite | 5.5 g/l |
| Acetic acid | 0.97 g/l |
| Water to make | 1 liter |
| pH | 6.4 |

Stabilizer

| | |
|---|---|
| Photo-Flo 200 Solution (manufactured by Eastman Kodak Co.) | 3 mL/l |

Bleach E (Comparison)

0.98 mol/l $H_2O_2$ 0.004 mol/l 1-hydroxyethylidene-1,1-diphosphonic acid

Water to 1 liter pH 3.0 adjusted with NaOH

Bleach F (Invention)

0.98 mol/l $H_2O_2$ 0.17 mol/l 3-(N-morpholino)-2-hydroxypropanesulfonic acid (MOPSO)

0.004 mol/l 1-hydroxyethylidene-1,1-diphosphonic acid

Water to 1 liter pH 3.0 adjusted with $H_2SO_4$

Film Sample E was treated with hydrogen peroxide Bleach E that contained 1-hydroxyethylidene-1,1-diphosphonic acid. Film Sample F was treated with hydrogen peroxide Bleach F of the invention. The residual silver of the samples was determined at maximum density by X-ray fluorescence, and is tabulated in Table III

TABLE III

X-ray fluorescence data for residual silver in g/m².

| BLEACH TIME (SEC) | SAMPLE E (40° C.) | SAMPLE F (40° C.) |
|---|---|---|
| 0.0 | 1.318 | 1.358 |
| 60 | 0.286 | 0.091 |
| 120 | 0.158 | 0.037 |
| 240 | 0.053 | 0.030 |

Example 2 shows that the addition of a sulfonic acid or a salt thereof improves the bleaching of an acidic hydrogen peroxide solution with 1-hydroxyethylidene-1,1-diphosphonic acid added to control vesiculation at room temperature. The above X-ray fluorescence data shows that at 40° C., bleaching of the film was possible within a shorter time than at room temperature (Example 2). In addition, the data shows that the invention more effectively bleached the film. Film vesiculation was caused by Bleach E, while no vesiculation was observed with the invention, Bleach F. Therefore, at higher temperatures the presence of a sulfonic acid or a salt thereof controls vesiculation.

It has been shown above that the addition of a compound described by Formula I improves the bleaching performance of an acidic hydrogen peroxide solution. In addition, hydrogen peroxide solutions with 1-hydroxyethylidene-1,1-diphosphonic acid, and one or more compounds described by Formula I are effective bleach baths for silver halide photographic materials both at room temperature and 40° C. In a preferred embodiment, solutions containing 0.98 to 1.96 mol/l hydrogen peroxide, 0.025 to 0.5 mol/l of a compound described by Formula I and with or without 0.004 to 0.012 mol/l 1-hydroxyethylidene-1,1-diphosphonic acid caused no vesiculation when bleaching developed silver halide photographic materials at a pH between 2 and 6, and more preferably between 3 and 5.

EXAMPLE 4

This example shows that the addition of bromide ion as a rehalogenating agent impairs the bleaching performance of an acidic peroxide bleaching composition.

Several experiments were carried out using the processing protocol of Example 3 above to process imagewise exposed KODACOLOR GOLD™ 100 color negative film. Bleaching was carried out for up to 480 seconds using the various solutions described below, and the residual silver (g/m²) was then measured using conventional procedures as described in Example 3. The results are plotted in FIG. 1.

The bleaching compositions contained the following materials. Each composition had a pH of 3.0.

Bleach G (Invention)

0.98 mol/l hydrogen peroxide (3%).

0.17 mol/l 3-(N-morpholino)-2-hydroxypropanesulfonic acid, 0.012 mol/l 1-hydroxyethylidene1,1-diphosphonic acid, and water to 1 liter;

Bleach H (Comparison)

0.98 mol/l hydrogen peroxide (3%).

0.17 mol/l 3-(N-morpholino)-2-hydroxypropanesulfonic acid, 0.012 mol/l 1-hydroxyethylidene1,1-diphosphonic acid, 1 mmol/l potassium bromide ion, and water to 1 liter;

Bleach I (Comparison)

0.98 mol/l hydrogen peroxide (3%).

0.17 mol/l 3-(N-morpholino)-2-hydroxypropanesulfonic acid, 0.012 mol/l 1-hydroxyethylidene-1,1-diphosphonic acid, 10 mmol/l potassium bromide ion, and water to 1 liter;.

Bleach J (Comparison)

0.98 mol/l hydrogen peroxide (3%).

0.17 mol/l 3-(N-morpholino)-2-hydroxypropanesulfonic acid, 0.012 mol/l 1-hydroxyethylidene-1,1-diphosphonic acid, 100 mmol/l potassium bromide ion, and water to 1 liter.

The results (residual silver in g/m² vs bleach time in seconds) of using these bleaching compositions are plotted in FIG. 1, and are identified as follows:

| | |
|---|---|
| Bleach G | Line 1 |
| Bleach H | Line 2 |
| Bleach I | Line 3 |
| Bleach J | Line 4 |

These data quite clearly show that only the use of a peroxide bleaching solution according to the present invention provides bleaching in an acceptable period of time. Thus, contrary to the teaching of U.S. Pat. No. 4,301,236 (Idota et al, Col. 7, lines 46–52) i.e., that halides are preferred additives for accelerating bleaching, the presence of bromide ion rehalogenating agent severely reduced bleaching in the bleaching compositions disclosed herein. As the amount of bromide ion rehalogenating agent was increased (from 1 to 100 mmol/l), bleaching was further reduced as evidenced by more residual silver in the processed photographic film.

Comparative Experimentation A:

These examples show that persulfate is not a hydrogen peroxide precursor for the purpose of providing hydrogen peroxide in the bleaching solutions of this invention. Residual silver data were generated using a hydrogen peroxide bleaching solution and with several comparative persulfate solutions.

Figure 2:
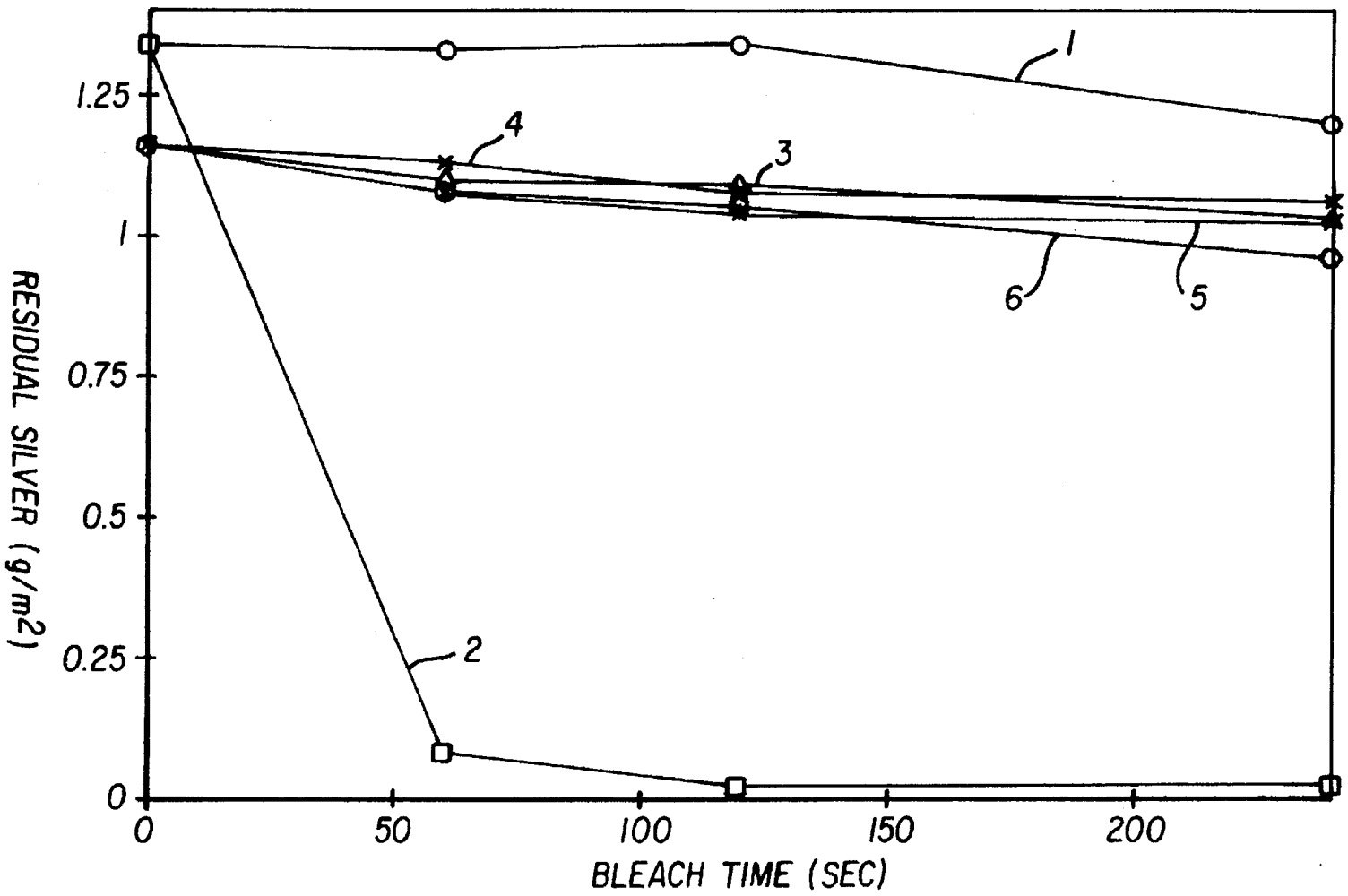
FIG. 2 is a graphical representation of the results (residual silver in $g/m^2$ vs. bleach time in seconds) of experiments carried out as described in "Comparative Experimentation A" below.

Experiments were carried out similarly to Example 3 above, using KODAK GOLD™ 100 Plus film and the processing protocol of that example. Bleaching was carried out from 0 to 240 seconds using each of the bleaching solutions K through P described below, and the residual silver (g/m²) was then measured using conventional procedures as described in Example 3. The bleaching results (residual silver in g/m² versus bleach time in seconds) are shown in FIG. 2.

The following solutions were tested:

Bleach K 0.98 mol/l sodium persulfate 0.035 mol/l acetic acid 0.004 mol/l 1-hydroxyethylidene-1,1-diphosphonic acid, and water to 1 liter, pH 3.65;

Bleach L 0.98 mol/l hydrogen peroxide (3%)

0.035 mol/l acetic acid 0.004 mol/l 1-hydroxyethylidene-1,1-diphosphonic acid, and water to make 1 liter, pH 3.65;

Bleach M

Commercial KODAK™ SR-30 Bleach comprising:

0.50 g/l gelatin hydrolysate 33 g/l sodium persulfate 15 g/l sodium chloride 9 g/l sodium dihydrogen phosphate (anhydrous)

2.50 mL phosphoric acid (85% solution), and water to make 1 liter pH 2.30;

Bleach N 60 g/l sodium persulfate 30 g/l sodium chloride 11.8 ml (85%) phosphoric acid 6.4 g/l sodium hydroxide 2 g/l β-aminopropionic acid, and water to make 1 liter, pH 2.7;

Bleach O (Comparison)

0.98 mol/l sodium persulfate 0.35 mol/l methanesulfonic acid 0.004 mol/l hydroxyethylidene-1,1-diphosphonic acid, and water to make 1 liter, pH 3.0; and Bleach P (Comparison)

0.98 mol/l sodium persulfate 0.17 mol/l 3-(N-morpholino)-2-hydroxypropanesulfonic acid (MOPSO)

0.004 mol/l hydroxyethylidene-1,1-diphosphonic acid, and water to make 1 liter, pH 3.0.

The results (residual silver in g/m$^2$ vs bleach time in seconds) from the use of these bleaching compositions are plotted in FIG. 2, and are identified as follows:

| | |
|---|---|
| Bleach K | Line 1 |
| Bleach L | Line 2 |
| Bleach M | Line 3 |
| Bleach N | Line 4 |
| Bleach O | Line 5 |
| Bleach P | Line 6 |

The data in FIG. 2 quite clearly show that only the hydrogen peroxide bleaching solution, Bleach L, effectively bleached silver in the described process. Bleach L (line 2) was the only solution that lowered the residual silver effectively. The other solutions, all persulfate solutions (FIG. 2, Lines 1 and 3–6), did not effectively bleach the photographic element after 240 seconds.

In addition, note that Bleach O (comparison) at 40° C. was ineffective while Bleach D (invention), with hydrogen peroxide in place of sodium persulfate, was very effective even at room temperature (Example 2 result).

Also note that Bleach P (comparison) was ineffective while Bleach F (invention), with hydrogen peroxide in place of sodium persulfate, was very effective (Example 3 result).

The invention has been described in detail with particular reference to preferred embodiments thereof, but it will be understood that variations and modifications can be effected within the spirit and scope of the invention.

We claim:

1. A method of processing an imagewise exposed and developed silver halide photographic element comprising bleaching said photographic element with a non-rehalogenating bleaching composition having a pH of from about 2 to about 6, and comprising:

a) hydrogen peroxide in an amount of from about 0.05 to about 5 mol/l, or a perborate, percarbonate or hydrogen peroxide urea precursor which releases hydrogen peroxide in an aqueous solution at a pH of from about 2 to about 6, said precursor being present in an amount sufficient to provide hydrogen peroxide in an amount of from about 0.05 to about 5 mol/l, and b) from about 0.01 to about 2 mol/l of a sulfonic acid compound that is methanesulfonic acid, aminoethanesulfonic acid, 2-hydroxyethanesulfonic acid, 2-(N-morpholino)ethanesulfonic acid, 3-(N-morpholino) propanesulfonic acid, 3-(N-morpholino)-2-hydroxypropanesulfonic acid, 3-(N-(tris (hydroxymethyl)methyl)amino)-propanesulfonic acid, 3-(N- (tris (hydroxymethyl)methyl)amino)-2-hydroxypropanesulfonic acid, 3-(cyclohexylamino)-1-propanesulfonic acid, 3-(cyclohexylamino)-2-hydroxy-1-propanesulfonic acid, ethanesulfonic acid, propanesulfonic acid, butanesulfonic acid, hexanesulfonic acid, benzenesulfonic acid, naphthalenesulfonic acid, 2-(N-(tris(hydroxymethyl)methyl) amino)ethane sulfonic acid, sulfoacetic acid, or sulfosuccinic acid, or a salt thereof and provided said bleaching composition is substantially free of:

rehalogenating agents, and a complex of a high valent metal ion and any of a polycarboxylic acid represented by Formula II, an aminocarboxylic acid represented by Formula III or a phosphonic acid represented by Formula IV or V $$R^1(COOH)_t \qquad \text{(II)}$$

wherein $R^1$ represents a single bond, an unsubstituted or substituted alkylene group having 1 to 6 carbon atoms wherein the substituent is a hydroxy group and/or a carboxy group, a $—(CH_2)_m—O—(CH_2)_n—$ group wherein m and n are integers and m+n is 2 to 6, a $—(CH_2)_{m'}—S—(CH_2)_{n'}—$ group wherein m' and n' are integers and m'+n' is 2 to 6, or an alkenylene group having 2 to 6 carbon atoms; t is 2 or 3; and when $R^1$ is a single bond, t is 2,

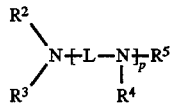

(III)

wherein $R^2$, $R^3$, $R^4$ and $R^5$ each represents a carboxyalkyl group wherein the alkyl moiety has 1 to 2 carbon atoms, a hydroxyalkyl group having 1 to 2 carbon atoms and/or a hydrogen atom; p represents zero or an integer of 1 to 3; L represents an alkylene group having 2 to 4 carbon atoms, a $$\text{[}(CH_2)_x\text{]}_z\text{[}O\text{[}(CH_2)_y\text{]}_z\text{]}$$

group wherein x is an integer of 2 to 4, y is an integer of 2 to 4 and z is an integer of 1 to 3, a 6-membered cyclic alkylene group, or an arylene group; and the aminocarboxylic acid of the formula (III) has at least 1 carboxy group, $$R^6[PO_3H_2]_q \quad (IV)$$

$$R^6[L\text{-}PO_3H_2]_q \quad (V)$$

wherein $R^6$ represents a substituted or unsubstituted alkyl or alkylene group having 1 to 4 carbon atoms wherein the substituent is a hydroxy group and/or a carboxy group, or a substituted or unsubstituted diaminoalkylene group having 2 to 16 carbon atoms wherein the substituent is a hydroxy group; L represents an alkylene group having 1 to 2 carbon atoms; and q represents an integer of 1 to 5.

2. The method of claim 1 wherein the bleaching composition further comprises an organic phosphonic acid or salt thereof.

3. The method of claim 2 wherein said organic phosphonic acid or salt thereof is represented by formula (VI):

$$R^7N(CH_2PO_3M'_2)_2 \quad (VI)$$

wherein M' represents a hydrogen atom or a cation imparting water solubility; and $R^7$ represents an alkyl group, an alkylaminoalkyl group, or an alkoxyalkyl group having from 1 to 4 carbon atoms, an aryl group, an aralkyl group, an alicyclic group, or a heterocyclic group, each of which may be substituted with a hydroxyl group, an alkoxy group, a halogen atom, $—PO_3M'_2$, $—CH_2PO_3M'_2$, OR $—N(CH_2PO_3M'_2)_2$, wherein M' is as defined above, or by formula (VII):

$$R^8R^9C(PO_3M'_2)_2 \quad (VII)$$

wherein M' is as defined above; $R^8$ represents a hydrogen atom, an alkyl group, an aralkyl group, an alicyclic group, or a heterocyclic group, or $—CHR^{10}—PO_3M'_2$, wherein M' is as defined above and $R^{10}$ represents a hydrogen atom, a hydroxy group, or an alkyl group, or $—PO_3M'_2$, wherein M' is as defined above; $R^9$ represents a hydrogen atom, a hydroxyl group or an alkyl group, or the above defined substituted alkyl group, or $—PO_3M'_2$ wherein M' is as defined above.

4. The method of claim 1 wherein the pH of said bleaching composition is from about 3 to about 6.

5. The method of claim 1 wherein the sulfonic acid or salt thereof is present in said bleaching composition at a concentration of from about 0.03 to about 1.0 mol/l.

6. The method of claim 1 wherein said bleaching composition further comprises soluble silver(I).

7. The method of claim 1 wherein the sulfonic acid or salt thereof is present at from about 0.045 to about 0.5 mol/l.

8. The method of claim 2 wherein said organic phosphonic acid is ethylenediamine-N,N,N',N'-tetramethylenephosphonic acid, nitrilo-N,N,N-trimethylenephosphonic acid, 1,2-cyclohexanediamine-N,N,N',N'-tetramethylenephosphonic acid, o-carboxyaniline-N,N-dimethylenephosphonic acid, propylamine-N,N-dimethylenephosphonic acid, 4-(N-pyrrolidino)butylamine-N,N-bis(methylenephosphonic acid), 1,3-diamino-2-propanol-N,N,N',N'-tetramethylenephosphonic acid, 1,3-propanediamine-N,N,N',N'-tetramethylenephosphonic acid, 1,6-hexanediamine-N,N,N',N'-tetramethylenephosphonic acid, o-acetamidobenzylamine-N,N-dimethylenephosphonic acid, o-toluidine-N,N-dimethylenephosphonic acid, 2-pyridylmethylamine-N,N-dimethylenephosphonic acid, 1-hydroxyethane-1,1-diphosphonic acid, diethylenetriamine-N,N,N',N'',N''-penta (methylenephosphonic acid), 1-hydroxy-2-phenylethane-1,1-diphosphonic acid, 2-hydroxyethane-1,1-diphosphonic acid, 1-hydroxyethane-1,1,2-triphosphonic acid, 2-hydroxyethane-1,1,2-triphosphonic acid, ethane-1,1-diphosphonic acid, or ethane-1,2-diphosphonic acid.

9. The method of claim 2 wherein said organic phosphonic acid is present in said bleaching composition in an amount of from about 0.0005 to about 0.02 mol/l.

10. The method of claim 9 wherein said organic phosphonic acid is present in said bleaching composition in an amount of from about 0.0005 to about 0.012 mol/l.

11. The method of claim 1 carried out in a low volume thin tank processor.

12. The method of claim 1 wherein said silver halide photographic element is a color silver halide photographic element.

13. The method of claim 12 wherein said color silver halide photographic element is a photographic negative-working film comprising a silver bromoiodide emulsion.

14. The method of claim 12 wherein said color silver halide photographic element is a photographic positive-working film.

15. The method of claim 1 wherein said bleaching composition comprises less than about $10^{-5}$ mole of said rehalogenating agent per liter of solution, and less than about $10^{-4}$ mole of said complex of a high valent metal ion per liter of solution.

16. The method of claim 1 wherein said imagewise exposed and developed silver halide photographic element which had been color developed, is contacted with an acidic processing solution prior to bleaching with said non-rehalogenating hydrogen peroxide bleaching composition.

* * * * *